US007802783B2

(12) United States Patent
Matsushima

(10) Patent No.: US 7,802,783 B2
(45) Date of Patent: Sep. 28, 2010

(54) IMAGE FORMING APPARATUS

(75) Inventor: Ryoichi Matsushima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 204 days.

(21) Appl. No.: 11/856,365

(22) Filed: Sep. 17, 2007

(65) Prior Publication Data

US 2008/0067732 A1 Mar. 20, 2008

(30) Foreign Application Priority Data

Sep. 20, 2006 (JP) ..... 2006-254769

(51) Int. Cl.
*B65H 5/00* (2006.01)

(52) U.S. Cl. ..... 271/10.13; 271/259; 271/265.02

(58) Field of Classification Search ..... 271/10.13, 271/256, 259, 264, 265.02; 399/21, 18
See application file for complete search history.

(56) References Cited

U.S. PATENT DOCUMENTS

| | | | | |
|---|---|---|---|---|
| 6,773,009 | B2 * | 8/2004 | So | 271/259 |
| 7,354,038 | B2 * | 4/2008 | Watase | 271/10.13 |
| 7,496,300 | B2 * | 2/2009 | Dan | 399/21 |
| 2006/0029402 | A1 | 2/2006 | Dan | |

FOREIGN PATENT DOCUMENTS

| | | | |
|---|---|---|---|
| JP | 61-178339 | A | 8/1986 |
| JP | 3-251291 | A | 11/1991 |
| JP | 04-2920 | Y2 | 1/1992 |
| JP | 05-004762 | A | 1/1993 |
| JP | 7-191592 | A | 7/1995 |
| JP | 10-045269 | A | 2/1998 |
| JP | 10-329986 | A | 12/1998 |
| JP | 2000-191184 | A | 7/2000 |
| JP | 2006-21844 | A | 1/2006 |
| JP | 2006-47664 | A | 2/2006 |

OTHER PUBLICATIONS

JP Office Action Jul. 10, 2008, JP App. 2006-254769.

* cited by examiner

*Primary Examiner*—Kaitlin S Joerger
(74) *Attorney, Agent, or Firm*—Banner & Witcoff, Ltd.

(57) ABSTRACT

An image forming apparatus includes a feeding roller configured to rotate responsive to drive force received from a motor to convey a recording medium via a manual feed input, and a clutch device configured to be switched between first and second modes in which the motor drive force is transmitted to the feeding roller and prevented from being transmitted to the feeding roller, respectively. The apparatus includes a sensor disposed between the manual feed input and the feeding roller for detecting the recording medium, and a control unit configured to maintain the clutch device in the first mode while controlling the motor to drive the feeding roller to feed the recording medium while the sensor detects that the recording medium is fed through the manual feed input.

8 Claims, 7 Drawing Sheets

IMAGE FORMING APPARATUS

CROSS REFERENCE TO RELATED APPLICATION

The present application claims priority to and the benefit of Japanese Patent Application No. 2006-254769, which was filed on Sep. 20, 2006, the disclosure of which is incorporated herein by reference in its entirety.

BACKGROUND

1. Field

Aspects of the invention relate to an image forming apparatus.

2. Description of Related Art

Known image forming apparatuses have printing functions to perform printing by feeding a sheet (recording medium) one by one from a sheet stack in a sheet input tray to an image forming unit, as well as by feeding a sheet manually inserted through a manual feed slot by a user to the image forming unit. For example, Japanese Laid-Open Patent Publication No. 5-4762 discloses an image forming apparatus in which a manual sheet feeding path from a manual feed slot and an input tray feeding path from a sheet input tray join in front of registration rollers into one sheet feeding path to an image forming unit. A sensor and sheet feed rollers for manual sheet feeding are disposed on the manual sheet feeding path. When the sensor detects the sheet inserted through the manual feed slot, the sheet feed roller rotates for a predetermined time to feed the sheet to a position immediately before the registration rollers. Because the sheet is held by the sheet feed rollers, a user does not have to hold the sheet until printing starts. When the image forming apparatus receives print data for one page transmitted from an external computer, the sheet is fed by the registration rollers and the sheet feed rollers to the image forming unit where printing is performed on the sheet.

Because manual sheet feeding may not be performed very frequently, the sheet feed rollers for manual sheet feeding may be omitted from an image forming apparatus, as shown in FIG. 6, to simplify the structure of the image forming apparatus or reduce its size. In such an image forming apparatus, a first sensor 101, registration rollers 102, and a second sensor 103 are disposed downstream of a manual feed slot 100 in a manual sheet feeding direction, respectively. The first sensor 101 and the second sensor 103 are disposed in front of and behind the registration rollers 102, respectively. A photosensitive drum 104 and a transfer roller 105 of the image forming unit are disposed downstream of the second sensor 102 in the manual sheet feeding direction, so as to face each other. The registration rollers 102 and the photosensitive drum 104 are mechanically connected to a motor 106 and rotated by a drive force from the main motor 106. A clutch mechanism including a solenoid 107 is disposed between the registration rollers 102 and the main motor 106. When the solenoid 107 is turned off, the drive force from the main motor 106 is transmitted to the registration rollers 102. When the solenoid 107 is turned on, the drive force from the main motor 106 is not transmitted to the registration rollers 102. When a sheet is fed from the sheet input tray, the solenoid 107 is activated for a predetermined time to make the leading end of the sheet contact the stopped registration rollers 102. Thus, skew of the sheet is reduced.

Manual feed printing performed in the image forming apparatus shown in FIG. 6 will be described with reference to a timing chart of FIG. 7.

In a standby state, when the first sensor 101 detects a sheet inserted by a user through the manual feed slot, the main motor 106 starts to rotate. Accordingly, the registration rollers 102 rotate and the sheet is nipped between the rollers 102. When the sheet is fed a predetermined length, the solenoid 107 is turned on, to stop the rotation of the registration rollers 102. The main motor 106 also stops.

Thereafter, when the image forming apparatus starts to receive print data from the external computer, the main motor 106 starts to rotate. At this time, the solenoid 107 is still turned on, so that the registration rollers 102 will not rotate. In response to completion of reception and processing of the print data, the solenoid 107 is turned off and the registration rollers 102 start conveying the sheet. When the second sensor 103 detects the leading end of the sheet, the photosensitive drum 104 is exposed to a laser beam to form an electrostatic latent image thereon, based on the detection timing of the sheet by the second sensor 103. When the sheet passes between the photosensitive drum 104 and the transfer roller 105, an image is printed on or transferred to the sheet.

In the above-described structure, the solenoid 107 is kept turned on after the sheet is fed the predetermined length by the registration rollers 102 into the image forming apparatus, to stop the transmission of the drive force from the main motor 106 to the registration rollers 102 until the print data processing is finished. However, the time required to finish the print data processing after the sheet is fed by the registration rollers 102, will be affected by the time when a user starts sending print data after inserting a sheet into the manual feed slot, and an amount of print data (print contents). For example, when the amount of print data is great, a relatively long time is required for processing the print data after reception of the print data. Accordingly, the solenoid 107 is kept turned on for a long time. This can cause the solenoid 107 to become overheated.

SUMMARY

Accordingly, aspects of the invention provide an image forming apparatus in which drive force from a main motor is not interrupted when a recoding medium is fed in manual feed printing.

BRIEF DESCRIPTION OF THE DRAWINGS

Illustrative aspects of the invention will be described in detail with reference to the following figures wherein.

DETAILED DESCRIPTION

Illustrative aspects of the invention will be described in detail with reference to FIGS. 1 to 5.

General Structures of Laser Printer

Figure 1:
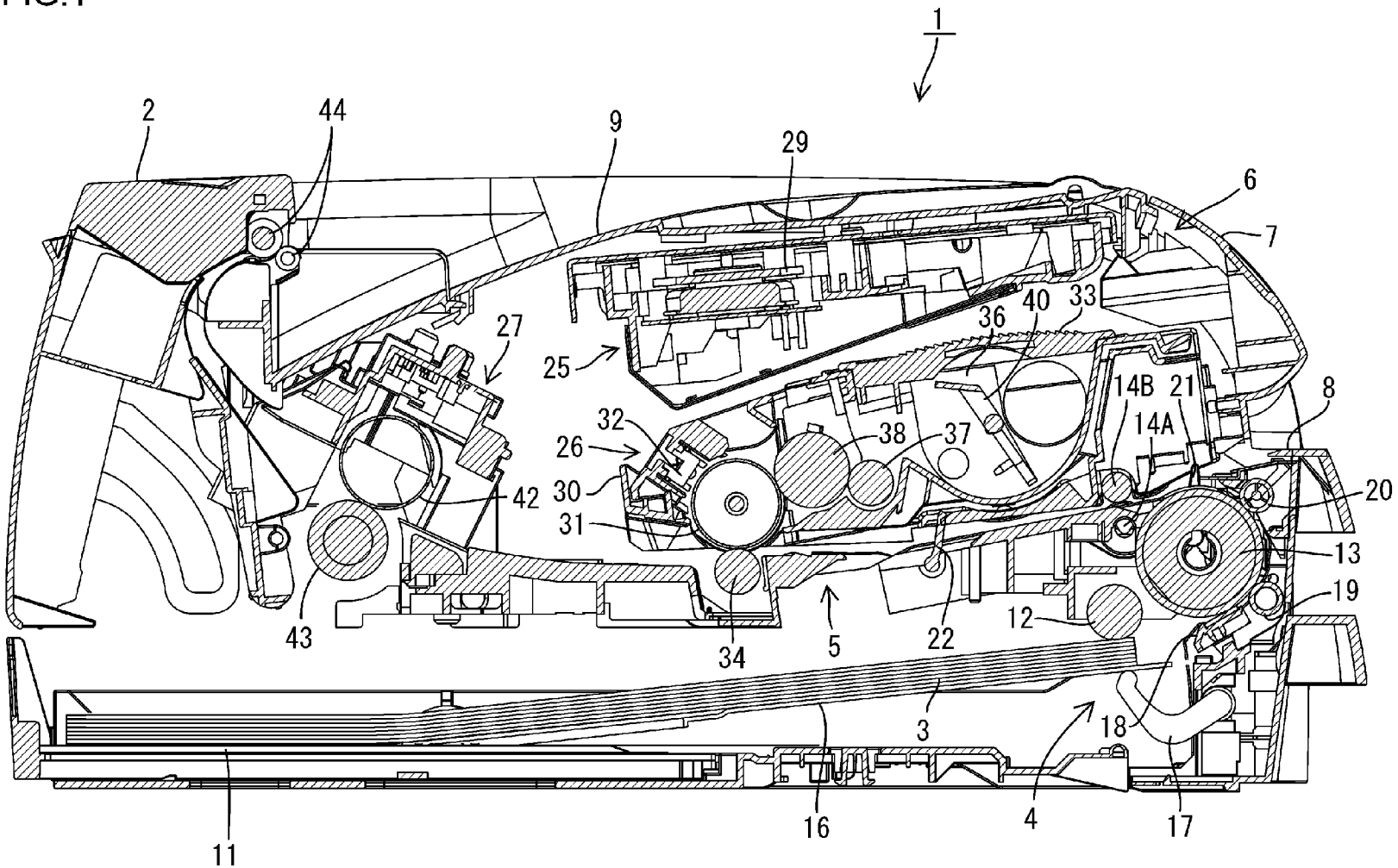
FIG. 1 is a side sectional view of a laser printer according to an illustrative aspect of the invention.

General structures of an illustrative laser printer 1, as an image forming apparatus, will be described with reference FIG. 1. The laser printer 1 includes a casing 2 in which a sheet supply unit 4 configured to supply a sheet 3, as an example of a recording medium, and an image forming unit 5 configured to form an image on the sheet 3 are disposed. In the following description, the right side in FIG. 1 is referred to as the front side of the laser printer 1 and the direction perpendicular to the sheet of FIG. 1 is the right and left direction of the laser printer 1.

(1) Casing

The casing 2 is provided at a front face with an opening 6 through which a process cartridge 26 (described below) is removably installed in the laser printer 1. A front cover 7 is disposed in the casing 2 to cover or uncover the opening 6. A manual feed input, such as manual feed slot 8 is disposed at a lower portion of the front cover 7 to manually feed the sheet 3 into the casing 2 for manual feed printing. Disposed on an upper face of the casing 2 is a sheet output tray 9 to which the sheet 3 having an image formed thereon is output.

(2) Sheet Supply Unit

The sheet supply unit 4 includes a sheet input tray 11 functioning as an illustrative supply tray, a pick-up roller 12, a sheet supply roller 13 functioning as an illustrative supply device, and registration rollers 14A, 14B functioning as illustrative feeding rollers. The sheet input tray 11 is disposed at a bottom portion of the casing 2 so as to slide in the front and rear direction. The sheet input tray 11 is configured to accommodate a stack of the sheets 3 therein. The pick-up roller 12 is disposed at an upper front end of the sheet input tray 11 when the sheet input tray 11 is set in the casing 2. The sheet supply roller 13 is disposed at an upper front side of the pick-up roller 12. The registration rollers 14A, 14B are disposed at an upper rear side of the sheet supply roller 13. The sheet supply unit 4 is configured to feed the sheet 3, which may be supplied from the sheet input tray 11 or inserted through the manual feed slot 8, to the image forming unit 5.

The sheet input tray 11 is provided with a pivotable sheet mount plate 16. The front end of the sheet mount plate 16 is raised by an urging force of a lever 17, which is pivotally disposed at the front end of the sheet input tray 11. The sheets 3 mounted on the sheet mount plate 16 are pressed against the pick-up roller 12 as the front end of the sheet mount plate 16 is raised.

A separation pad 18 is disposed below the sheet supply roller 13 so as to elastically contact the sheet supply roller 13. When the pick-up roller 12 rotates in a state where the sheets 3 on the sheet mount plate 16 are pressed against the pick-up roller 12, the sheets 3 are fed toward a portion between the sheet feel roller 13 and the separation pad 18. When the sheets 3 are held between the sheet feel roller 13 and the separation pad 18 by the rotation of the sheet supply roller 13, the top sheet 3 is separated from other sheets 3 and fed in a sheet feeding direction.

A pinch roller 19 and a sheet dust removing roller 20 are disposed in contact with the sheet supply roller 13 downstream of the separation pad 18 in the sheet feeding direction. The sheet 3 fed from the separation pad 18 passes between the sheet supply roller 13 and the pinch roller 19. Fiber or dusts on the sheet 3 may be removed by the sheet dust removing roller 20. Then, the sheet 3 is fed toward the registration rollers 14A, 14B.

A sheet feeding path from the sheet input tray 11 to the registration rollers 14A, 14B and a sheet feed path from the manual feed slot 8 to the registration rollers 14A, 14B join at a position above the sheet supply roller 13. A first sensor 21 configured to detect the sheet 3 is disposed in front of the registration rollers 14A, 14B near the intersection of the two sheet feeding paths. The registration roller 14A is a drive roller configured to rotate the registration roller 14B, which is disposed above the registration roller 14A in contact therewith. A second sensor 22 configured to detect the sheet 3 is disposed downstream of the registration rollers 14A, 14B in the sheet feeding direction, that is, behind the registration rollers 14A, 14B. The image forming unit 5, which will be described below, is disposed downstream of the second sensor 22 in the sheet feeding direction.

(3) Image Forming Unit

The image forming unit 5 includes a scanner unit 25, a process cartridge 26, and a fixing unit 27.

(a) Scanner Unit

The scanner unit 25 is disposed at an upper portion of the casing 2. The scanner unit 25 emits a laser beam from a laser beam emitting portion (not shown) based on image data to a surface of a photosensitive drum 31 via a rotatable polygon mirror 29 and a plurality of lenses and reflecting mirrors (not shown).

(b) Process Cartridge

The process cartridge 26 is removably installed in the casing 2 below the scanner unit 25. The process cartridge 26 is provided with the photosensitive drum 31, a scorotron charger 32, a developing cartridge 33, and a transfer roller 34 in a frame 30.

The photosensitive drum 31 includes a metal drum body that is grounded. The surface of the drum body is coated with a positively chargeable photosensitive layer.

The scorotron charger 32 generates corona discharge to charge the surface of the photosensitive drum 31 uniformly and positively.

The developing cartridge 33 is box-shaped. The developing cartridge 33 is removably mounted on the frame 30. The developing cartridge 33 includes a toner chamber 36, a supply roller 37, and a developing roller 38.

The toner chamber 36 contains positively chargeable toner. The toner in the toner chamber 36 is agitated by an agitator 40 disposed in the toner chamber 36.

The toner discharged from the toner chamber 36 is supplied to the developing roller 38 by the rotation of the supply roller 37. At this time, the toner is positively charged by the friction between the supply roller 37 and the developing roller 38. While the developing roller 38 rotates, the toner carried onto the surface of the developing roller 38 passes between the developing roller 38 and a layer thickness regulating blade (not shown), which is pressed against the surface of the developing roller 38. At this time, the toner is further charged by friction between the developing roller 38 and the layer thickness regulating blade and carried on the surface of the developing roller 38 as a thin layer whose thickness has been regulated.

The surface of the photosensitive drum 31 is uniformly and positively charged by the scorotron charger 32 while the photosensitive drum 31 rotates. Then, the surface of the photosensitive drum 31 is selectively exposed to the laser beam emitted from the scanner unit 25, to form on the surface of the drum 31 an electrostatic latent image corresponding to an image to be formed on the sheet 3.

As the developing roller 38 rotates, the positively charged toner carried on the developing roller 38 contacts the photosensitive drum 31. At this time, the toner is supplied to the electrostatic latent image formed on the surface of the photosensitive drum 31, thereby developing the electrostatic latent image into a visible toner image on the surface of the photosensitive drum 31.

Thereafter, the toner image carried on the surface of the photosensitive drum 31 is transferred to the sheet 3 when the sheet 3 passes through a transfer position between the photosensitive drum 31 and the transfer roller 34, with a negative transfer bias applied to the transfer roller 34. The sheet 3 having the toner image transferred thereon is conveyed to the fixing unit 27.

(c) Fixing Unit

The fixing unit 27 includes a heat roller 42, a pressure roller 43 pressed against the heat roller 42. The heat roller 42 includes a heat source, such as a halogen lamp.

In the fixing unit 27, the toner image transferred onto the sheet 3 is fixed to the sheet 3 by the heat application while the sheet 3 passes between the heat roller 42 and the pressure roller 43.

Then, the sheet 3 is conveyed to sheet output rollers 44 disposed at an upper portion of the casing 2 and output to the sheet output tray 9 by the sheet output rollers 44.

Electrical Configuration of the Laser Printer

Figure 2:
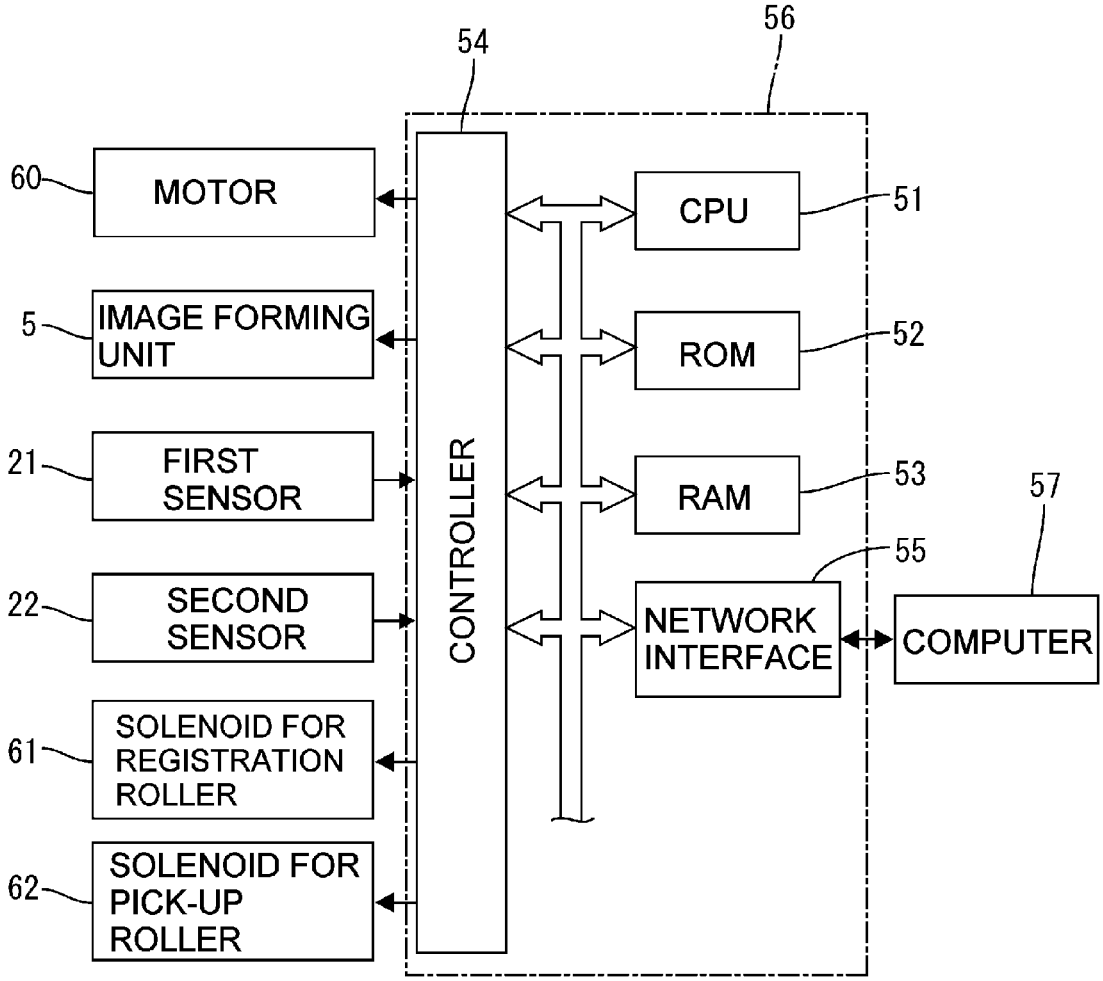
FIG. 2 is a block diagram showing an electrical configuration of the laser printer.

An electrical configuration of the laser printer 1 will be described with reference to FIG. 2. The laser printer 1 includes a control device 56. The control device 56 includes a CPU (central processing unit) 51 functioning as an illustrative control unit, a ROM (read only memory) 52, a RAM (random access memory) 53, a controller 54, and a network interface 55.

The ROM 52 stores various control programs for controlling the laser printer 1, various settings and default values.

The RAM 53 is used as a working area for various processing by the CPU 51, and as a storage area for temporarily storing print data.

The CPU 51 controls components of the laser printer 1 via the controller 54, based on control programs stored in the ROM 52, while storing processing results in the RAM 53.

The network interface 55 is connected with an external device, such as a computer 57. The network interface 55 receives print commands and print data transmitted from the computer 57.

The controller 54 may include an ASIC (application specific integrated circuit). The controller 54 is electrically connected with components of the laser printer 1, such as a main motor 60, the image forming unit 5, the first and second sensors 21, 22, a solenoid 61 for the registration roller 14A functioning as an illustrative clutch device, and a solenoid 62 for the pick-up roller 12.

The main motor 60 is connected with the pick-up roller 12, the sheet supply roller 13, the registration roller 14A, the developing roller 38, the photosensitive drum 31, the heat roller 42, and the sheet output rollers 44 via a gear mechanism (not shown) so as to rotate thee rollers 12, 13, 14A, 38, 42, 44 and the drum 31 in synchronization with each other.

The solenoid 61 is provided as a clutch mechanism for connecting and disconnecting the transmission of the drive force between the main motor 60 and the registration roller 14A in first and second modes, respectively. When the solenoid 61 is turned off responsive to a control signal from the CPU 51 via the controller 54, power is not supplied to the solenoid 61 and the drive force is transmitted from the main motor 60 to the registration roller 14A in the first mode. When the solenoid 61 is turned on responsive to a control signal from the CPU 51 via the controller 54, power is supplied to the solenoid 61 and the drive force is not transmitted from the main motor 60 to the registration roller 14A in the second mode.

The solenoid 62 is provided as a clutch mechanism for connecting and disconnecting the transmission of the drive force between the main motor 60 and the pick-up roller 12. When the solenoid 62 is turned on, power is supplied to the solenoid 62 and the drive force is transmitted from the main motor 60 to the pick-up roller 12. When the solenoid 62 is turned off, power is not supplied to the solenoid 62 and the drive force is not transmitted from the main motor 60 to the pick-up roller 12.

The pick-up roller 12 and the sheet supply roller 13 are connected with each other via the gear mechanism. When the solenoid 62 is turned on, the drive force from the main motor 60 is also transmitted to the sheet supply roller 13. When the solenoid 62 is turned off, the drive force from the main motor 60 is not transmitted to the sheet supply roller 13.

The laser printer 1 is configured to perform sheet input tray printing in which an image is formed on the sheet 3 supplied from the sheet input tray 11, and manual feed printing in which an image is formed on the sheet 3 manually inserted through the manual feed slot 8.

(Sheet Input Tray Printing)

Figure 3:
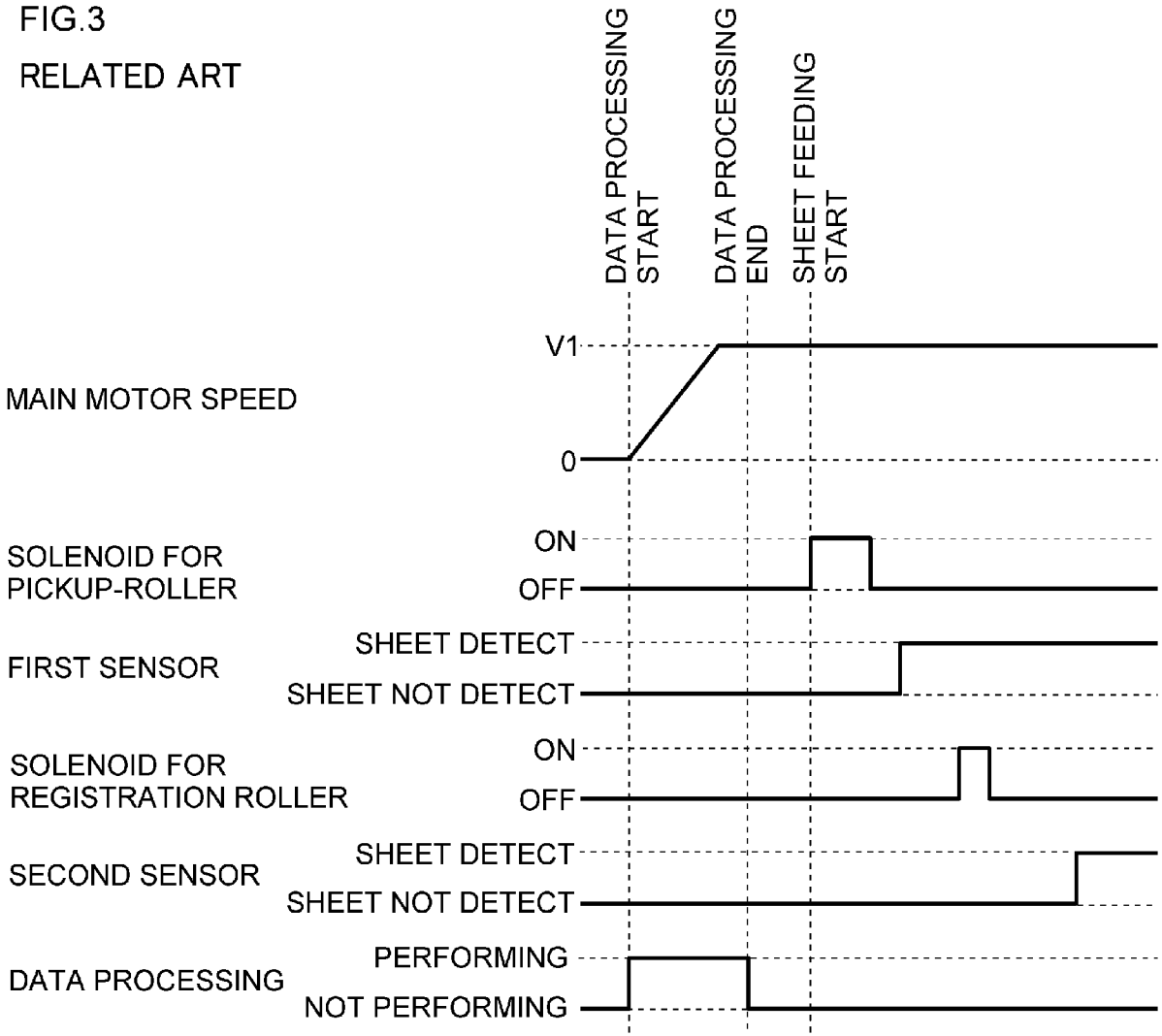
FIG.3 RELATED ART
FIG. 3 is a timing chart showing timing of operations in sheet input tray printing.

Sheet input tray printing will be described with reference to FIG. 3. When the CPU 51 receives a command for sheet input tray printing from the computer 57 in a standby state, the CPU 51 receives print data from the computer 57 and starts the processing of the print data in the RAM 53. The main motor 60 rotates at substantially same time that the processing of the print data is started. The main motor 60, which is stopped, increases rotational speed gradually to a first speed V1. When the rotational speed reaches the first speed V1, the main motor 60 rotates at a constant speed of the first speed V1. In accordance with the rotation of the main motor 60, the sheet supply roller 13, the registration roller 14A and the photosensitive drum 31 are rotated.

Then, the processing of the print data for one page is complete. Responsive to completion of the data processing, the solenoid 62 for the pick-up roller 12 is turned on for a certain period of time. Thus, the drive force is transmitted from the main motor 60 to the pick-up roller 12 for a certain period of time, to rotate the pick-up roller 12 once. When the pick-up roller 12 is rotating, the sheets 3 accommodated in the sheet input tray 11 are fed between the sheet supply roller 13 and the separation pad 18. The top sheet 3 is separated from other sheets 3 and is fed by the sheet supply roller 13 in the sheet feeding direction. After the pick-up roller 12 rotates once, the pick-up roller 12 stops.

When the first sensor 21 detects the leading end of the sheet 3, the solenoid 61 for the registration roller 14A is turned on for a certain period of time, based on the detection timing of the leading end of the sheet 3 by the first sensor 21 responsive to a control signal from the CPU 51 via the controller 54. Accordingly, transmission of the drive force to the registration roller 14A is temporarily stopped and the rotation of the registration rollers 14A, 14B stop for a certain period of time to account for skew. The leading end of the sheet 3, which is fed by the sheet supply roller 13, contacts the stopped registration rollers 14A, 14B to reduce the skew of the sheet 3.

Thereafter, as the registration roller 14A rotates again responsive to a control signal from the CPU 51 via the controller 54, the sheet 3 is conveyed by the registration rollers 14A, 14B in the sheet feeding direction. When the second sensor 22 detects the leading end of the sheet 3, the timing of laser beam emission from the scanner unit 25 to the photosensitive drum 31 is adjusted, based on the detection timing of the leading end of the sheet 3 by the second sensor 22. Thus, the photosensitive drum 31 is exposed to the laser beam to form an electrostatic latent image on the photosensitive drum 31. An image is transferred to the sheet 3 when it passes between the photosensitive drum 31 and the transfer roller 34.

(Manual Feed Printing)

The manual feed printing will be described below with reference to FIGS. 4 and 5.

Figure 4:
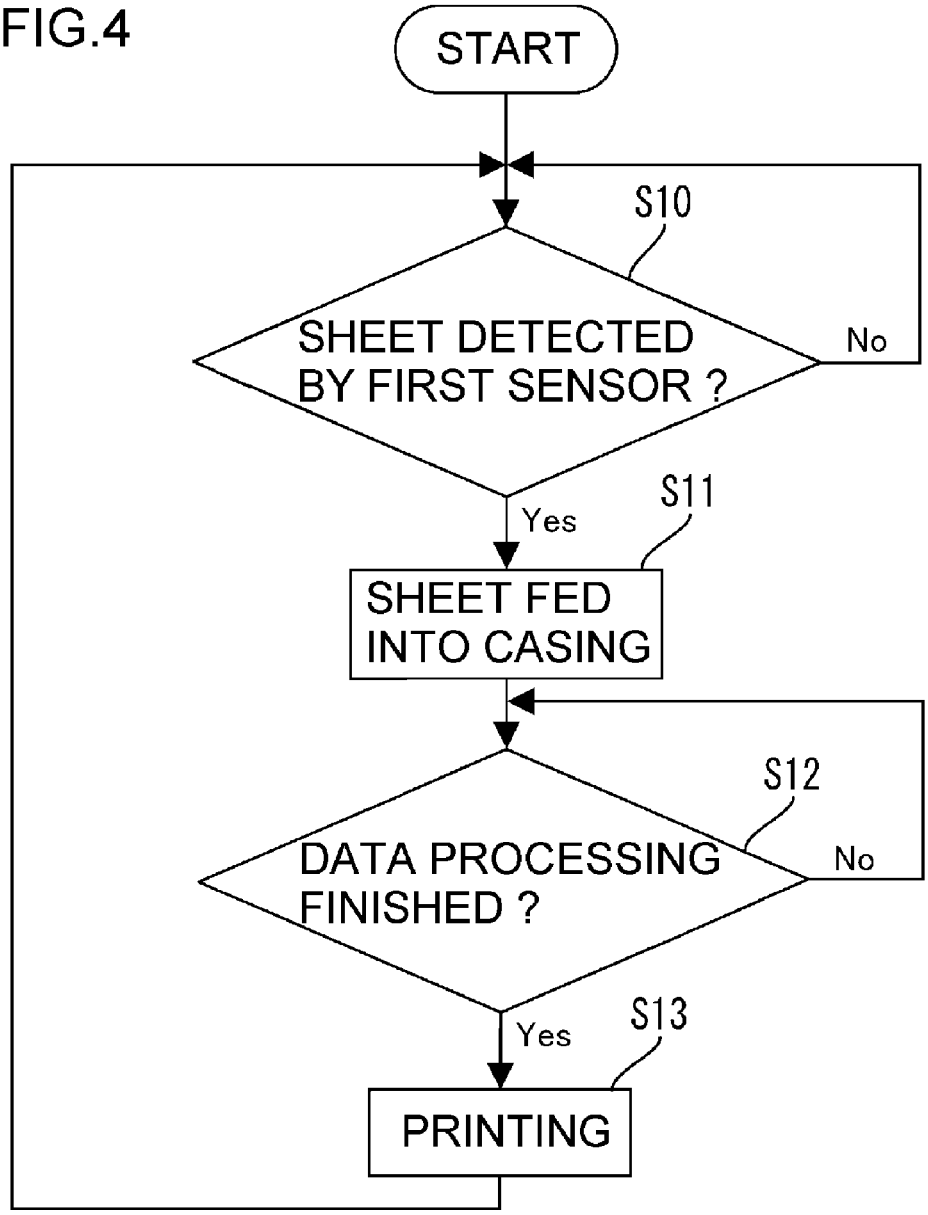
FIG. 4 is a flowchart showing processes of manual feed printing.
Figure 5:
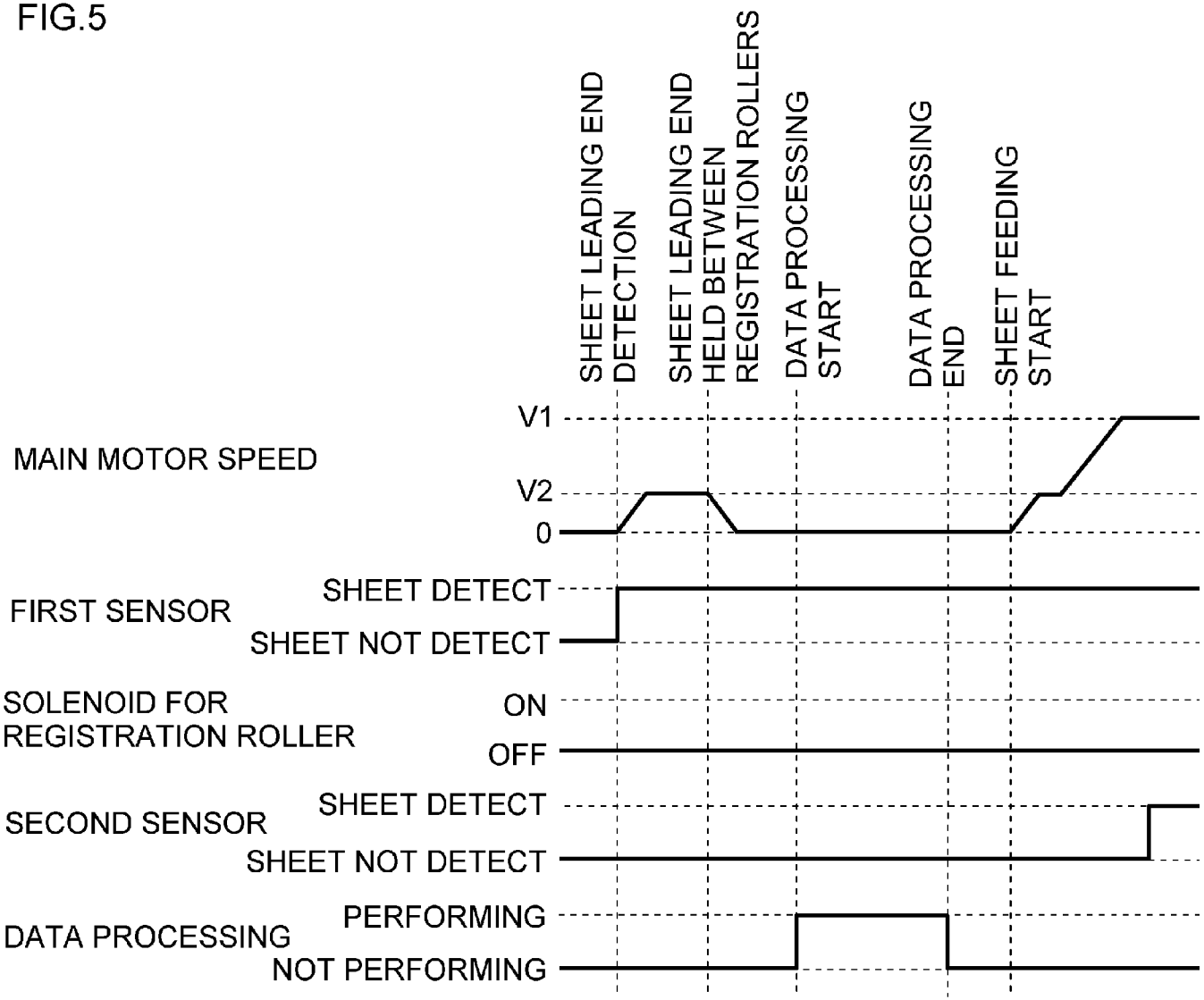
FIG. 5 is a timing chart showing timing of operations in manual feed printing.
Figure 6:
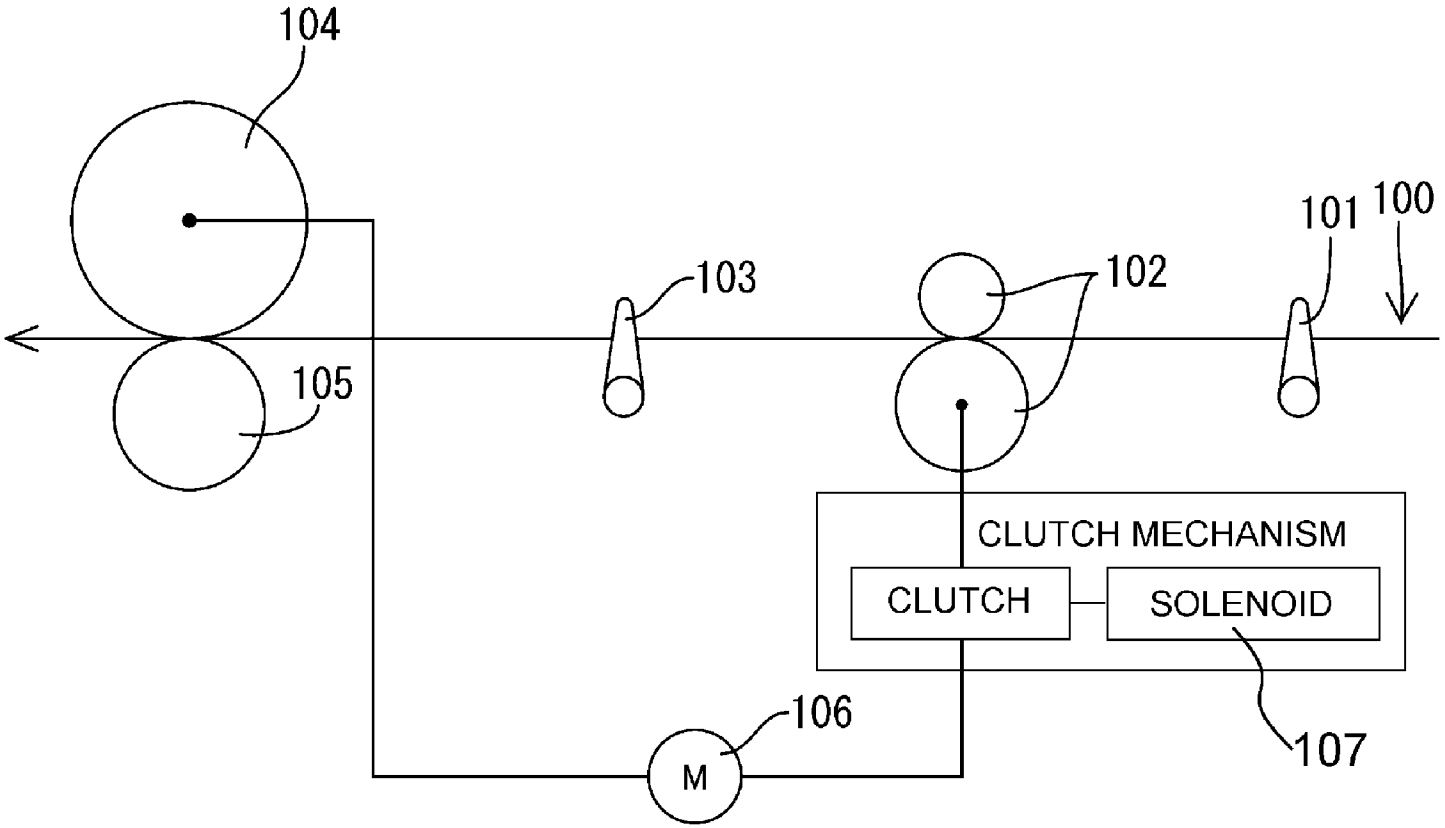
FIG. 6 is a schematic showing an arrangement of components used in the manual feed printing.
Figure 7:
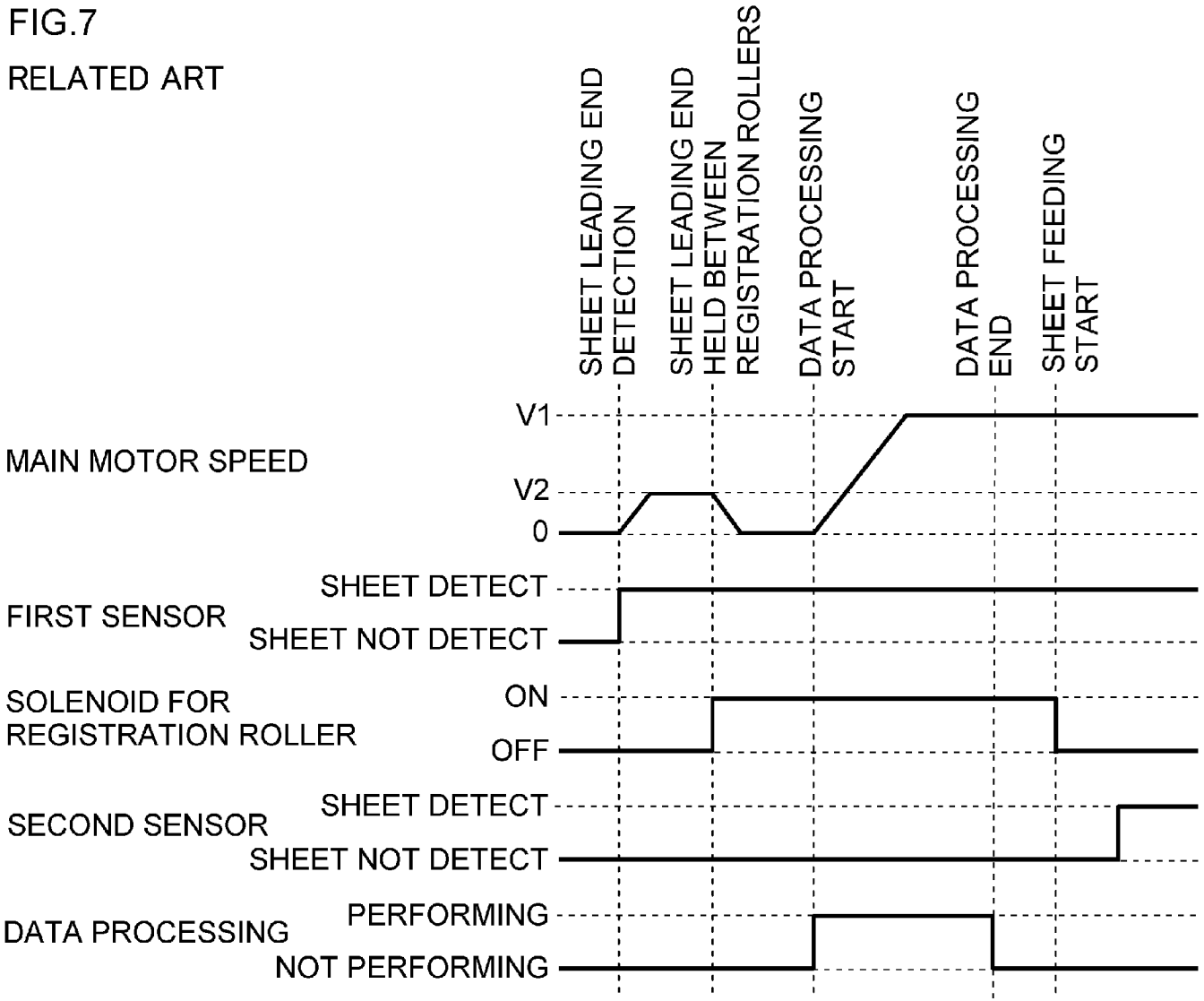
FIG.7 RELATED ART
FIG. 7 is a timing chart showing timing of operations in the sheet input tray printing.

As shown in FIG. 4, the CPU 51 monitors or determines whether the sheet 3 is inserted through the manual feed slot 8 using the first sensor 21 (S10) in a standby state. When CPU 51 determines that the first sensor 21 detects the leading end of the sheet 3 (S10: Yes), feeding of the sheet 3 is started. First, the CPU 51 starts rotating the main motor 60. The main motor 60 increases its rotational speed gradually to a second speed V2, which is lower than the first speed V1, as shown in FIG. 5. When the rotational speed reaches the second speed V2, the main motor 60 rotates at a constant speed of the second speed V2. At this time, the solenoid 61 for the registration roller 14A remains turned off, so that the registration roller 14A is rotated by the drive force from the main motor 60. The inserted sheet 3 is fed by the registration rollers 14A, 14B into the casing 2 (S11). The rotational speed of the registration roller 14A is proportional to the rotational speed of the main motor 60. Accordingly, the speed of sheet feeding by the registration rollers 14A, 14B in manual feed printing (corresponding to the second speed V2) is lower than the speed in sheet input tray printing (corresponding to the first speed V1). The main motor 60 stops after a lapse of a predetermined time from the start of its rotation responsive to a control signal from the CPU 51 via the controller 54. Consequently, the registration rollers 14A, 14B also stop, so that the leading end of the sheet 3 held or nipped between the registration rollers 14A, 14B may stop in front of the second sensor 22.

Thereafter, the CPU 51 receives print data transmitted from the computer 57 and performs the processing of the print data in the RAM 53. When the CPU 51 finishes processing the print data for one page (S12: Yes), printing is performed by rotating the main motor 60 again (S13). That is, the main motor 60, which is stopped, increases its rotational speed to the second speed V2 and then to the first speed V1 responsive to the completion of processing of the print data. The main motor 60 rotates at a constant speed of the first speed V1. In accordance with the rotation of the main motor 60, the registration roller 14A rotates to start feeding the sheet 3. The rotational speed of the main motor 60 reaches the first speed V1 before the leading end of the sheet 3 arrives at the second sensor 22. In other words, when the leading end of the sheet 3 arrives at the second sensor 22, the speed of the sheet feeding by the registration rollers 14A, 14B reaches the speed of the sheet feeding during printing. The main motor 60 does not have to be rotated so as to increase its rotational speed stepwise up to the first speed V1, while rotating the main motor 60 at the second speed V2 for a while. The rotational speed of the main motor 60 may be increased directly or straightly to the first speed V1.

When the second sensor 22 detects the leading end of the sheet 3, the timing of laser beam emission from the scanner unit 25 to the photosensitive drum 31 is adjusted, based on the detection timing of the leading end of the sheet 3 by the second sensor 22. Thus, the photosensitive drum 31 is exposed to the laser beam to form an electrostatic latent image on the photosensitive drum 31. An image is transferred on the sheet 3 when it passes between the photosensitive drum 31 and the transfer roller 34. When the manual feed printing on the sheet 3 is complete, flow returns to S10 and the laser printer 1 is placed in the standby state.

According to an aspect of the invention, in manual feed printing, driving or stopping the main motor 60 causes the register roller 14A to rotate or stop, respectively, without activating the solenoid 61, that is without supplying power to the solenoid 61. Thus, heat generation by the solenoid 61 may be reduced.

In addition to manual feed printing, the laser printer 1 may perform sheet input tray printing in which printing is performed on the sheet 3 fed from the sheet input tray 11. The first sensor 21 functions as a sensor for detecting the leading end of the sheet 3 in sheet input tray printing. The registration rollers 14A, 14B function as rollers for reducing skew of the sheet 3. Thus, components used in manual feed printing and sheet input tray printing may be shared. Thus, the structure of the laser printer 1 may be simplified and the size of the printer 1 may be reduced.

The rotational speed of the registration roller 14A when the registration rollers 14A, 14B feed the sheet 3 during manual feed printing is lower than the rotational speed during sheet input tray printing. Thus, a portion of the sheet 3 fed by the registration roller 14A, 14B in manual feed printing is less than a portion of the sheet fed by the registration rollers 14A, 14B in sheet input tray printing. In manual feed printing, the rotational speed of the main motor 60, which is stopped, needs to be increased to the speed at the time of printing until the leading end of the sheet 3 reaches the image forming unit 5 (more specifically, the transfer position between the photosensitive drum 31 and the transfer roller 34) after the sheet 3 held between the registration rollers 14A, 14B is fed in the sheet feeding direction. Therefore, the distance between the image forming unit 5 and the registration roller 14A (more specifically, the leading end of the sheet 3 held between the registration rollers 14A, 14B) needs to be sufficient to allow the main motor 60 to increase its rotational speed. According to an aspect of the invention, the portion of the sheet 3 fed by the registration rollers 14A, 14B, in other words, the portion of the sheet 3 from a nip portion between the registration rollers 14A, 14B to the leading end, is smaller in manual feed printing than in sheet input tray printing. Therefore, even when the distance between the registration rollers 14A, 14B and the image forming unit 5 is reduced, the rotational speed of the main motor 60 may be increased to a required value before the leading end of the sheet 3 reaches the image forming unit 5. Reduction of the distance between the registration rollers 14A, 14B and the image forming unit 5 may lead to a reduction in the size of the laser printer 1.

The invention is not limited to the above-described example structures and illustrative aspects. Various modifications may be made. In the above described example structures, when the registration roller 14A feeds the sheet 3 to the transfer position, its rotational speed during manual feed printing and sheet input tray printing is substantially the same. However, the rotational speed of the registration roller 14A to feed the sheet 3 to the transfer position in manual feed printing may be set lower than the rotational speed in sheet input tray printing. At this time, the rotational speed of the registration roller 14A and the rotational speed of the photosensitive drum 31 may be separately controlled. More specifically, when the sheet 3 is fed by the registration rollers 14A, 14B to the transfer potion in the image forming unit 5 in manual feed printing, the main motor 60 may be rotated at a constant speed of the second speed V2. If the rotational speed of the registration roller 14A is thus set lower in manual feed printing, the distance between the registration rollers 14A, 14B and the transfer position may be reduced. Thus, the laser printer 1 may be reduced in size.

While the invention has been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the invention disclosed herein. It is intended that the specification and the described examples are illustrative with the true scope of the invention being defined by the following claims.

What is claimed is:

1. An image forming apparatus, comprising:

a casing including a manual feed input through which a recording medium is inserted;

a sheet supply unit comprising an input tray in which a recording medium is stored, a pickup roller for picking up a recording medium in the input tray, and a supply roller for supplying a recording medium picked up by the pick up roller;

a motor;

a feeding roller configured to rotate responsive to drive force received from the motor, the feeding roller being configured to convey the recording medium inserted through the manual feed input in a sheet feeding direction and configured to convey the recording medium supplied from the supply roller in the sheet feeding direction;

a clutch device, the clutch device configured to be switched between a first mode in which the drive force from the motor is transmitted to the feeding roller and a second mode in which the drive force is prevented from being transmitted from the motor to the feeding roller;

a first sensor configured to detect the recording medium, the first sensor being disposed between the manual feed input and the feeding roller;

a second sensor configured to detect the recording medium, the second sensor being disposed downstream of the feeding roller in the sheet feeding direction;

an image forming unit configured to form an image and apply the image to the recording medium, the image forming unit being disposed downstream of the second sensor in the sheet feeding direction; and a control unit, wherein when the feeding roller feeds the recording medium from the manual feed input, the control unit is configured to:

maintain the clutch device in the first mode while controlling the motor to drive the feeding roller to feed the recording medium into the casing responsive to the first sensor detecting that the recording medium is fed through the manual feed input;

control the motor to stop before a leading end of the recording medium reaches the second sensor responsive to the first sensor detecting the recording medium without switching the clutch device from the first mode to the second mode; and control the motor to drive the feeding roller to feed the recording medium to the image forming unit and to cause the image forming unit to form the image on the recording medium based on the second sensor detecting the recording medium, wherein when the feeding roller feeds the recording medium from the sheet supply unit, the control unit is configured to:

control the clutch device to switch from the first mode to the second mode to stop the feeding roller before a leading end of the recording medium reaches the second sensor responsive to the first sensor detecting the recording medium with the motor being continuously driven; and control the clutch device to switch from the second mode to the first mode to drive the feeding roller to feed the recording medium to the image forming unit and to cause the image forming unit to form the image on the recording medium based on the second sensor detecting the recording medium.

2. The image forming apparatus according to claim 1, further comprising:

a sheet input tray configured to accommodate recording media therein; and a supply device configured to supply a recording medium of the recording media accommodated in the sheet input tray to the feeding roller;

wherein when the first sensor detects a leading end of the recording medium supplied from the sheet input tray by the supply device, the control unit switches the clutch device to the second mode to prevent transmission of the drive force from the motor to the feeding roller for a predetermined time period and then, responsive to passage of the predetermined time period switches the clutch device to the first mode to allow transmission of the drive force from the motor to the feeding roller to feed the recording medium to the image forming unit.

3. The image forming apparatus according to claim 2, wherein the control unit controls the motor to drive the feeding roller to convey the recording medium, which is fed through the manual feed input, into the casing, at a driving speed less than a driving speed for driving the feeding roller when the recording medium supplied from the sheet input tray is fed by the feeding roller to the image forming unit.

4. The image forming apparatus according to claim 1, wherein the clutch device comprises:

a clutch disposed between the motor and the feeding roller in a path for transmitting the drive force from the motor to the feeding roller; and a solenoid configured to switch the clutch between the first mode and the second mode, wherein responsive to receiving power, the solenoid switches the clutch to the second mode and responsive to receiving no power, the solenoid switches the clutch to the first mode.

5. In an image forming apparatus including a feeding roller, a motor and a clutch, the clutch configured to be switched between a first mode in which the drive force from the motor is transmitted to the feeding roller and a second mode in which the drive force is prevented from being transmitted from the motor to the feeding roller, a method for feeding a recording medium to an image forming unit comprising the steps of:

a) detecting a recording medium in a manual feed input;

b) transmitting drive force from the motor to drive the feeding roller, in the first mode, to feed the recording medium in a sheet feeding direction through the manual feed input to a nipping position in which the recording medium is nipped by the feeding roller responsive to the detecting;

c) controlling the motor to stop transmission of the drive force to the feeding roller, in the first mode, when the recording medium reaches the nipping position and before a leading end of the recording medium is able to be detected by a sensor located downstream from the feeding roller;

d) processing input data after transmission of the drive force from the motor has been stopped;

e) responsive to completion of the processing of the input data, transmitting drive force from the motor to drive the feeding roller a first rate of speed, in the first mode, to feed the recording medium to the image forming unit;

f) maintaining a clutch device in the first mode while detecting that the recording medium is in the manual feed input through steps b), c), d) and e) without switching the clutch device to the second mode;

g) detecting when the recording medium reaches a sensing position in which the leading end of the recording medium is able to be detected by the sensor responsive to completion of processing the input data; and h) controlling the motor to drive the feeding roller at a second rate of speed higher than the first rate of speed to feed the recording medium to the image forming unit responsive to detecting that the recording medium reaches the sensing position.

6. The method of claim 5, further comprising the steps of:

receiving a command for sheet input tray printing;

processing input data responsive to receiving the command;

transmitting drive force from the motor to drive a sheet supply roller and the feeding roller, in the first mode, to feed the recording medium from a sheet input tray in the sheet feeding direction to the nipping position in which the recording medium is nipped by the feeding roller responsive to receiving the command;

detecting by the sensor the leading end of the recording medium supplied from the sheet input tray;

switching the clutch to the second mode to prevent transmission of the drive force from the motor to the feeding roller for a predetermined time period; and responsive to passage of the predetermined time period, switching the clutch device to the first mode to allow transmission of the drive force from the motor to the feeding roller to feed the recording medium to the image forming unit.

7. The method of claim 5, wherein the clutch device includes a clutch disposed between the motor and the feeding roller in a path for transmitting the drive force from the motor to the feeding roller, and a solenoid configured to switch the clutch between the first mode and the second mode, wherein responsive to receiving power, the solenoid switches the clutch to the second mode and responsive to receiving no power, the solenoid switches the clutch to the first mode, and the step of maintaining the clutch device in the first mode further comprising providing no power to the solenoid during steps b), c), d) and e).

8. The image forming apparatus according to claim 4, wherein the control unit provides no power to the solenoid when controlling the motor to stop before a leading end of the recording medium reaches the second sensor and when controlling the motor to drive the feeding roller to feed the recording medium to the image forming unit and to cause the image forming unit to form the image on the recording medium based on the second sensor detecting the recording medium.

* * * * *